US009878215B1

(12) United States Patent
Stanford

(10) Patent No.: US 9,878,215 B1
(45) Date of Patent: Jan. 30, 2018

(54) TENNIS BALL RETRIEVAL APPARATUS WITH ENHANCED BALL RETENTION CAPABILITY

(71) Applicant: David Lee Stanford, San Diego, CA (US)

(72) Inventor: David Lee Stanford, San Diego, CA (US)

(73) Assignee: David Lee Stanford, San Diego, CA (US)

( * ) Notice: Subject to any disclaimer, the term of this patent is extended or adjusted under 35 U.S.C. 154(b) by 0 days.

(21) Appl. No.: 15/354,911

(22) Filed: Nov. 17, 2016

Related U.S. Application Data

(60) Provisional application No. 62/284,010, filed on Sep. 18, 2015.

(51) Int. Cl.
*A63B 47/02* (2006.01)
*A63B 60/40* (2015.01)

(52) U.S. Cl.
CPC ..... *A63B 47/02* (2013.01); *A63B 60/40* (2015.10)

(58) Field of Classification Search
CPC ..... A63B 47/00; A63B 47/02; A63B 60/38; A63B 60/40
See application file for complete search history.

(56) References Cited

U.S. PATENT DOCUMENTS 3,874,666 A * 4/1975 Ross ..... A63B 47/02 273/DIG. 30
3,989,247 A * 11/1976 Zimmerman ..... A63B 47/02 473/517
4,088,320 A * 5/1978 Brock ..... A63B 47/02 473/517
4,236,271 A * 12/1980 Martino ..... A63B 49/00 15/246
4,352,495 A * 10/1982 Marchionda ..... A63B 49/02 473/517
4,993,712 A * 2/1991 Urwin ..... A63B 47/02 273/DIG. 30
5,333,854 A * 8/1994 Woollard ..... A63B 47/02 473/517
5,383,661 A * 1/1995 Beck ..... A63B 47/02 473/517
5,947,850 A * 9/1999 Gray ..... A63B 47/02 294/19.2
6,719,651 B1 * 4/2004 Newey ..... A63B 47/02 423/517

(Continued)

*Primary Examiner* — Raleigh W Chiu
(74) *Attorney, Agent, or Firm* — Plager Schack LLP

(57) ABSTRACT

A tennis ball retrieval apparatus with enhanced ball retention capability coupled to a frame of a tennis racket is provided. The tennis ball retrieval apparatus includes a scoop assembly with an upper receptacle coupled to a base member, the base member having a generally U-shaped member coupled to the frame of the tennis racket, the upper receptacle having a generally spherical scoop with a front opening and an inner concave surface designed to conform to contours of the tennis ball. The tennis racket is maneuvered in a sweeping motion to permit the generally spherical scoop of the upper receptacle to scoop the tennis ball through the front opening. This permits the inner concave surface of the upper receptacle to conform to the tennis ball, thereby permitting the upper receptacle to retain the tennis ball therein.

5 Claims, 4 Drawing Sheets

(56) References Cited

U.S. PATENT DOCUMENTS 6,749,522 B1 * 6/2004 Aikman ..... A63B 47/02 294/19.2
D498,278 S * 11/2004 D'Agostino ..... D21/729
7,112,153 B1 * 9/2006 Beu ..... A63B 47/02 473/553
9,392,768 B1 * 7/2016 Mullin ..... F41B 3/04
2002/0169030 A1 * 11/2002 Chun-Sheng ..... A63B 47/02 473/286
2006/0063616 A1 * 3/2006 Nye ..... A63B 47/02 473/451
2006/0094545 A1 * 5/2006 Blades ..... A63B 47/02 473/524
2006/0138791 A1 * 6/2006 Lebovici ..... A63B 47/02 294/19.2
2007/0049396 A1 * 3/2007 Scheibe ..... A63B 47/02 473/282
2007/0111830 A1 * 5/2007 Wright ..... A63B 47/02 473/553
2007/0120385 A1 * 5/2007 Lindh ..... A63B 47/02 294/19.2
2007/0259731 A1 * 11/2007 Barouh ..... A63B 47/02 473/282
2007/0265119 A1 * 11/2007 Dyer ..... A63B 47/02 473/517
2008/0004140 A1 * 1/2008 Matsumoto ..... A01K 15/025 473/513
2008/0070715 A1 * 3/2008 Barouh ..... A63B 47/02 473/286
2008/0096685 A1 * 4/2008 Dempsey ..... A63B 47/02 473/286
2009/0176606 A1 * 7/2009 Blades ..... A63B 47/02 473/517
2010/0087280 A1 * 4/2010 Blades ..... A63B 47/02 473/517
2010/0234146 A1 * 9/2010 Mullin ..... A63B 47/02 473/517
2011/0224032 A1 * 9/2011 Kostouros ..... A63B 47/02 473/517
2015/0342146 A1 * 12/2015 Tucker ..... A01K 15/025 124/79

* cited by examiner

TENNIS BALL RETRIEVAL APPARATUS WITH ENHANCED BALL RETENTION CAPABILITY

RELATED APPLICATION

The application claims priority to provisional patent application U.S. Ser. No. 62/284,010 filed on Sep. 18, 2015, the entire contents of which is herein incorporated by reference.

BACKGROUND

The embodiments herein relate generally to ball retrieval devices.

Individuals engaging in sports or recreational activities often maneuver a ball on the ground such as a tennis ball, golf ball, bocce ball, baseball, cricket ball, and the like. Picking the ball up from the ground generally requires individuals to bend over and reach for the ball. This movement is problematic because it places an individual's body in an awkward position that subjects him/her to stress in his/her back, arms and other body areas.

This is a common occurrence in tennis because players often serve dozens or hundreds of tennis balls during a practice session. These balls become scattered throughout the floor on the tennis court. Bending over to pick up the tennis balls from the ground increases the chance the player will suffer pain and/or injuries to his/her back, legs, arms or other body areas.

Several ball retrieval devices exist as disclosed in U.S. Pat. Nos. 4,088,320, 5,947,850, 5,383,661, 7,112,153 and 3,989,247, and U.S. Patent Application Publications 2011/0224032, 2006/0094545 and 2007/0111830. These devices comprise a variety of ball retaining components such as arms, lips, wires, jaws, and the like, attached to the racket. The user maneuvers the racket to pick up a ball on the ground via the ball retaining components. However, these ball retrieval devices have several limitations. In particular, these devices: 1) do not effectively retain the tennis ball in place once picked up from the ground; and/or 2) are inefficient in picking up balls due to the difficulty in maneuvering the devices.

As such, there is a need in the industry for a tennis ball retrieval apparatus that addresses the limitations of the prior art, which effectively picks up a ball from the ground with enhanced efficiency and retains the secured ball in place.

SUMMARY

A tennis ball retrieval apparatus with enhanced ball retention capability coupled to a frame of a tennis racket is provided. The retrieval apparatus is configured to scoop a tennis ball from a ground surface with enhanced efficiency and reduced user effort. The tennis ball retrieval apparatus comprises a scoop assembly comprising an upper receptacle coupled to a base member, the base member comprising a generally U-shaped member coupled to the frame of the tennis racket, the upper receptacle comprising a generally spherical scoop with a front opening and an inner concave surface configured to conform to contours of the tennis ball, wherein the tennis racket is configured to maneuver in a sweeping motion to permit the generally spherical scoop of the upper receptacle to scoop the tennis ball through the front opening to permit the inner concave surface to conform to the tennis ball, thereby permitting the upper receptacle to retain the tennis ball therein. In certain embodiments of the invention, the upper receptacle of the scoop assembly comprises a top opening and a rear opening opposite the front opening.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
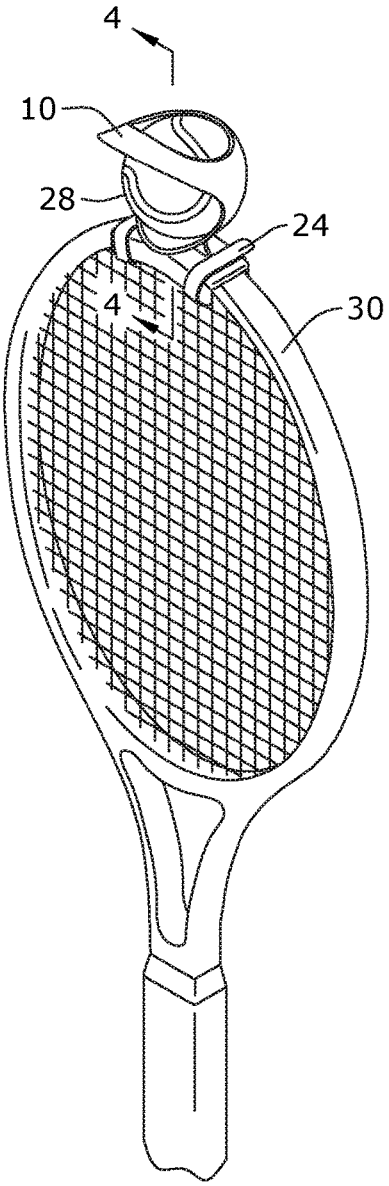
FIG. 1 depicts a perspective view of certain embodiments of the tennis ball retrieval apparatus shown in use.
Figure 2:
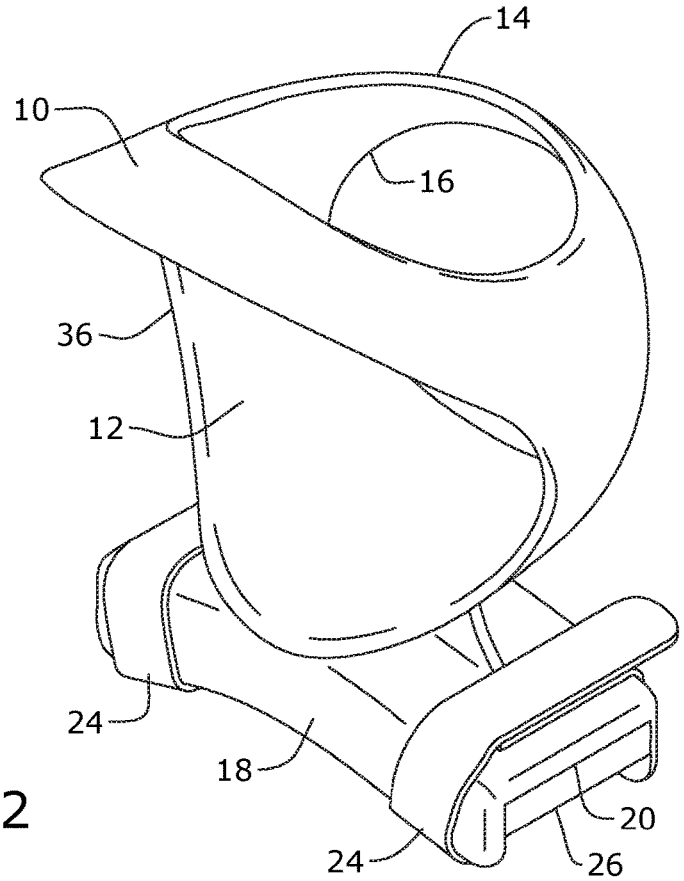
FIG. 2 depicts a perspective view of certain embodiments of the tennis ball retrieval apparatus.
Figure 3:
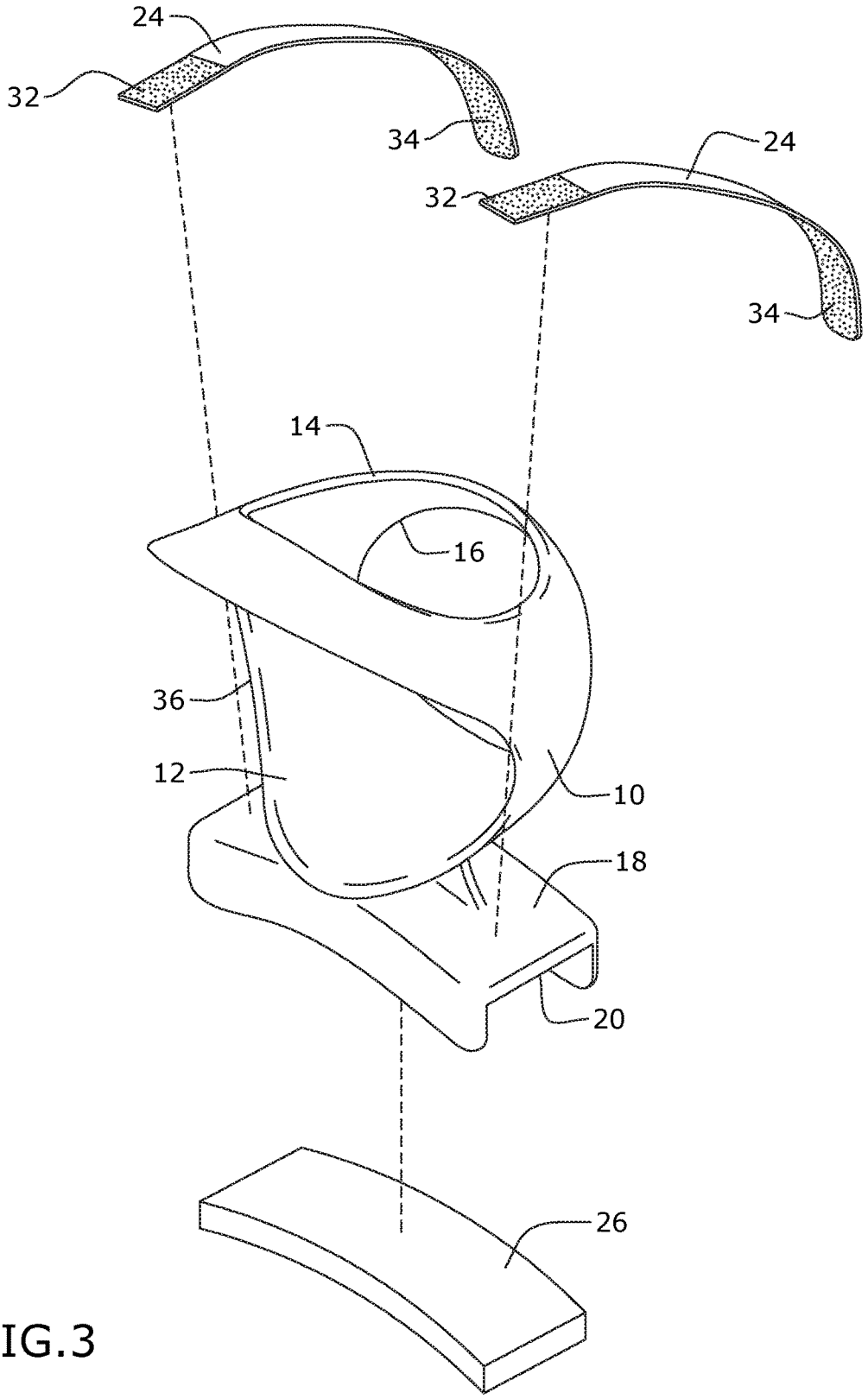
FIG. 3 depicts an exploded view of certain embodiments of the tennis ball retrieval apparatus.
Figure 4:
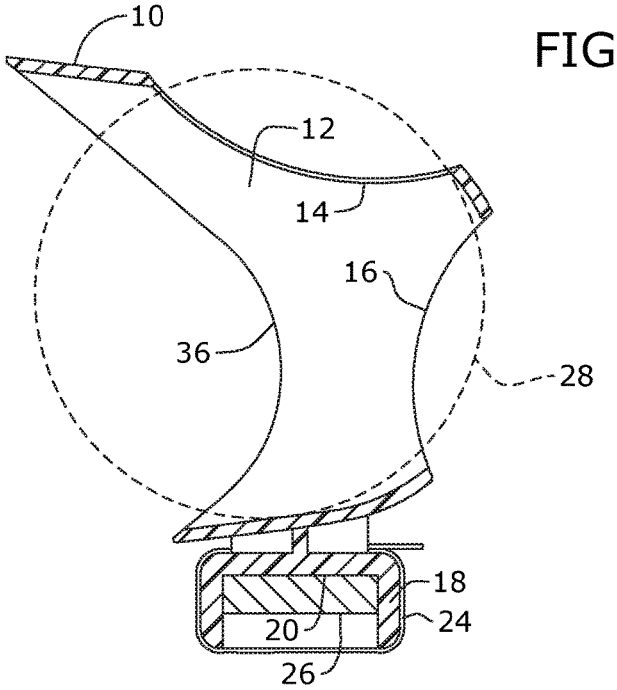
FIG. 4 depicts a section view of certain embodiments of the tennis ball retrieval apparatus taken along line 4-4 in FIG. 1.
Figure 5:
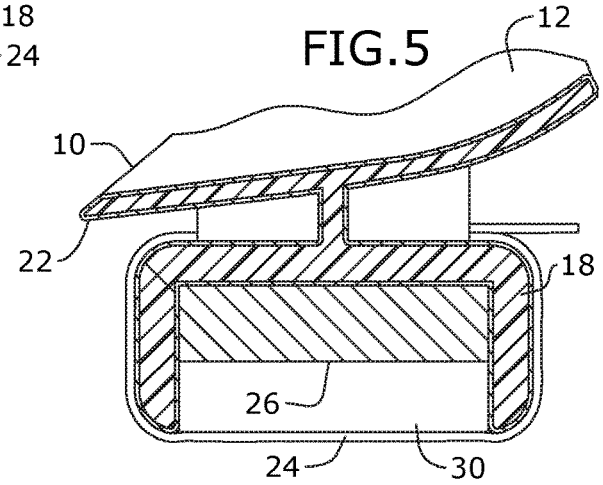
FIG. 5 depicts a section view of certain embodiments of the tennis ball retrieval apparatus.
Figure 6:
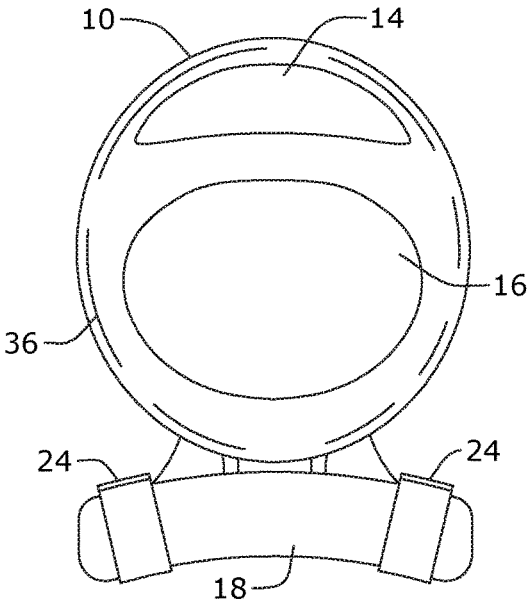
FIG. 6 depicts a front view of certain embodiments of the tennis ball retrieval apparatus.
Figure 7:
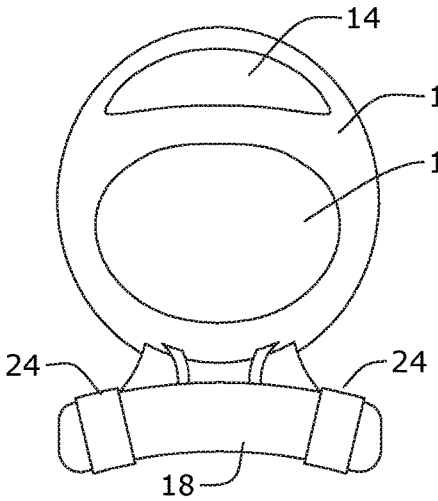
FIG. 7 depicts a rear view of certain embodiments of the tennis ball retrieval apparatus.
Figure 8:
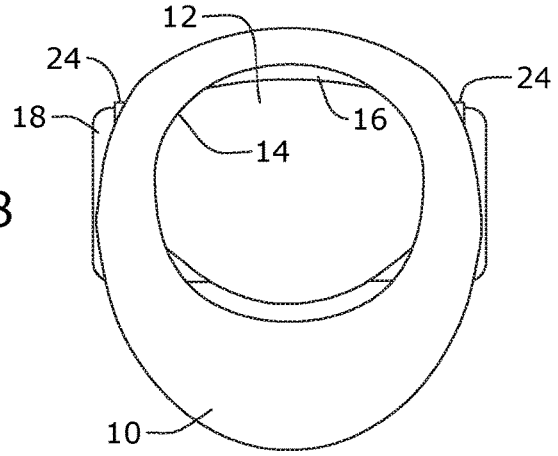
FIG. 8 depicts a top view of certain embodiments of the tennis ball retrieval apparatus.
Figure 9:
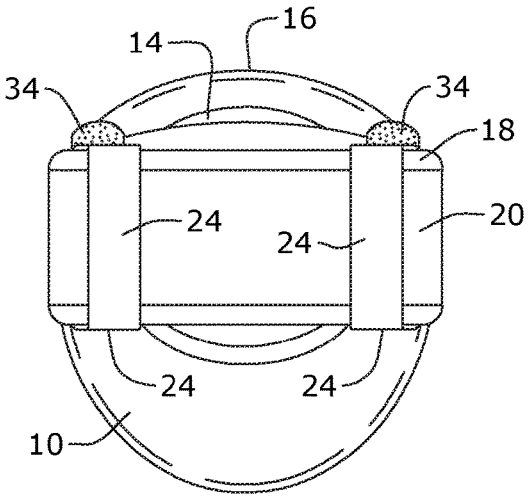
FIG. 9 depicts a bottom view of certain embodiments of the tennis ball retrieval apparatus.

As depicted in FIGS. 1-3, ball retrieval apparatus 10 is secured to a frame of tennis racket 30 and configured to scoop tennis ball 28 from a ground surface. Tennis ball 28 is retained within ball retrieval apparatus 10 until ready for use. In certain embodiments of the invention, ball retrieval apparatus 10 generally comprises spherical scoop member 12 and base 18.

As depicted in FIGS. 1-3 and 6-9, spherical scoop member 12 is connected to base 18 and both components are preferably made from a pliable plastic material. However, alternative materials known in the field may be used instead such as wood, metals or other synthetic materials. Spherical scoop member 12 comprises a receptacle with front opening 36, top opening 14 and rear opening 16. Front opening 36 is sufficiently large to permit tennis ball 28 to pass through when scooped by ball retrieval apparatus 10. Spherical scoop member 12 comprises an inner concave surface configured to conform to contours of tennis ball 28. This helps to retain tennis ball 28 therein when scooped by ball retrieval apparatus 10.

Front opening 36, rear opening 16 and top opening 14 create room for moisture or water to drain through and permit debris such as sand, twigs, leaves, dirt, rocks, or the like, to pass through. This prevents moisture, water and/or debris from hindering the ball retrieval apparatus' ability to scoop tennis ball 28 from the ground. In one embodiment, the size of front opening 36 is larger than the size of rear opening 16.

As depicted in FIGS. 2-5, base 18 comprises a generally U-shaped member with slot 20 configured to receive the frame of tennis racket 30. Cushion member 26 is disposed within slot 20 of base 18 and preferably is made from a compressible, deformable and resilient foam rubber material. Cushion member 26 is enclosed by base 18 and the frame of tennis racket 30 when the components are assembled together. A pair of straps 24 is used to secure base 18 to the frame of tennis racket 30. Each strap 24 comprises a top face with first fastener 32 and a bottom face with second fastener 34. Each fastener 32, 34 may comprise variable sizes and cover different portions of strap 24. In a preferred embodiment, first and second fasteners 32, 34 comprise corresponding hook and loop fasteners. However, alternative fasteners may be used instead such as snap components, slide fasteners, and the like.

In certain embodiments, coating 22 is applied to the outer surfaces of spherical scoop member 12 and/or base 18 to protect the components from wear, abrasions, and the like. In one embodiment, coating 22 comprises a TEFLON coating. However, alternative types of protective coatings may be used instead.

In operation, ball retrieval apparatus 10 is preferably secured to an upper frame portion of tennis racket 30 as depicted in FIG. 1. This is accomplished by inserting cushion member 26 and the frame of tennis racket 30 within slot 20 of base 18. Each strap 24 is wrapped around base 18 and the frame of tennis racket 30 by inserting the strap through the strings of the racket. Once each strap 24 is in place, the strap is folded to permit first fastener 32 to engage with second fastener 34. Straps 24 firmly secure ball retrieval apparatus 10 to tennis racket 30. In this position, cushion member 26 is compressed to further secure the connection of base 18 to tennis racket 30. The compressibility of cushion member 26 also helps ball retrieval apparatus 10 to accommodate different sized tennis rackets 30.

A user (not shown) maneuvers the handle of tennis racket 30 in a sweeping motion to permit spherical scoop member 12 to scoop and retain tennis ball 28 therein. The spherical shape permits spherical scoop member 12 to easily scoop tennis ball 28 with minimal user effort by using one hand. The inner concave surface of spherical scoop member 12 conforms to tennis ball 28. This cradles tennis ball 28 and improves the apparatus' ability to retain the ball in place. The user maneuvers the handle of tennis racket 30 to release tennis ball 28 from spherical scoop member 12 as needed. It shall be appreciated that front opening 36, rear opening 16 and top opening 14 enable moisture or water to drain through and permit debris such as sand, twigs, leaves, dirt, rocks, or the like, to pass through. This permits ball retrieval apparatus 10 to be effectively used in a variety of settings such as on the beach, a tennis court, park, or the like.

It shall be appreciated that the components of ball retrieval apparatus 10 described in several embodiments herein may comprise any alternative known materials in the field and be of any color, size and/or dimensions. It shall be appreciated that the components of ball retrieval apparatus 10 described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A tennis ball retrieval apparatus with enhanced ball retention capability coupled to a frame of a tennis racket, the retrieval apparatus configured to scoop a tennis ball from a ground surface with enhanced efficiency and reduced user effort, the tennis ball retrieval apparatus comprising:

a scoop assembly comprising an upper receptacle coupled to a base member, the base member comprising a generally U-shaped member coupled to the frame of the tennis racket, the upper receptacle comprising a generally spherical scoop with a front opening and an inner concave surface configured to conform to contours of the tennis ball;

wherein the tennis racket is configured to maneuver in a sweeping motion to permit the generally spherical scoop of the upper receptacle to scoop the tennis ball through the front opening to permit the inner concave surface to conform to the tennis ball, thereby permitting the upper receptacle to retain the tennis ball therein.

2. The tennis ball retrieval apparatus of claim 1, wherein the upper receptacle of the scoop assembly further comprises a top opening and a rear opening opposite the front opening.

3. The tennis ball retrieval apparatus of claim 2, wherein the front opening of the upper receptacle comprises a first opening size and the rear opening of the upper receptacle comprises a second opening size, wherein the first opening size is greater than the second opening size.

4. The tennis ball retrieval apparatus of claim 3, further comprising a cushion member disposed in space within the U-shaped member of the base member, wherein the cushion member is enclosed by the U-shaped member and frame of the tennis racket.

5. The tennis ball retrieval apparatus of claim 4, further comprising a pair of straps coupled to the tennis racket and base member of the scoop assembly, each strap of the pair of straps comprising a top face and a bottom face, the top face comprising a first fastener and the bottom face comprising a second fastener, wherein each strap is wrapped around the base member of the scoop assembly and frame of the tennis racket to permit the first fastener of the strap to engage with the second fastener of the strap.

* * * * *